US006901778B2

(12) United States Patent
Kim et al.

(10) Patent No.: US 6,901,778 B2
(45) Date of Patent: Jun. 7, 2005

(54) CLUTCH APPARATUS FOR WASHING MACHINE

(75) Inventors: Dong Hun Kim, Yongin (KR); Jun Ho Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 10/035,196

(22) Filed: Jan. 4, 2002

(65) Prior Publication Data

US 2003/0000263 A1 Jan. 2, 2003

(30) Foreign Application Priority Data

Jun. 27, 2001 (KR) ..... 10-2001-0037167

(51) Int. Cl.[7] ..... D06F 37/40

(52) U.S. Cl. ..... 68/23.6; 68/24; 68/133; 192/54.4

(58) Field of Search ..... 68/23.6, 23.7, 68/24, 133; 192/17 C, 17 D, 12 BA, 12 D, 53.2, 54.4, 84.1, 84.3

(56) References Cited

U.S. PATENT DOCUMENTS

| | | | | |
|---|---|---|---|---|
| 1,887,284 | A | * | 11/1932 | Brady, Jr. |
| 2,278,911 | A | * | 4/1942 | Breckenridge |
| 2,331,897 | A | * | 10/1943 | Dyer |
| 2,538,246 | A | * | 1/1951 | Holm-Hansen |
| 2,841,260 | A | * | 7/1958 | Lodge |
| 2,886,149 | A | * | 5/1959 | Baermann |
| 3,157,260 | A | * | 11/1964 | Straub et al. |
| 3,243,021 | A | * | 3/1966 | Pelensky |
| 3,257,830 | A | * | 6/1966 | Shelton |
| 3,369,381 | A | * | 2/1968 | Crane et al. |
| 3,403,538 | A | * | 10/1968 | Andrew et al. |
| 3,712,439 | A | * | 1/1973 | Schacher et al. |
| 3,893,191 | A | * | 7/1975 | Gold et al. |
| 4,232,536 | A | * | 11/1980 | Koseki et al. |
| 4,576,262 | A | * | 3/1986 | Mohan et al. |
| 4,589,534 | A | * | 5/1986 | Apetrei et al. |
| 4,819,460 | A | * | 4/1989 | Obradivic |
| 5,145,149 | A | * | 9/1992 | Moehle |
| 5,421,055 | A | * | 6/1995 | Harmon et al. |
| 5,737,944 | A | * | 4/1998 | Nishimura et al. |
| 5,989,151 | A | * | 11/1999 | Kershaw et al. |
| 6,176,108 | B1 | * | 1/2001 | Bae et al. |

FOREIGN PATENT DOCUMENTS

| | | | |
|---|---|---|---|
| DE | 2638944 | * | 3/1978 |
| DE | 197 26 180 | * | 12/1998 |
| JP | 58-99530 | * | 6/1983 |
| JP | 2-68099 | * | 3/1990 |
| JP | 10-311265 | * | 11/1998 |

* cited by examiner

*Primary Examiner*—Frankie L. Stinson
(74) *Attorney, Agent, or Firm*—Birch, Stewart, Kolasch & Birch, LLP

(57) ABSTRACT

A clutch apparatus of a washing machine is provided. The clutch apparatus includes a coupling unit comprising a magnetic unit at least in one part, combined around the basket shaft, and combined with a rotor of the driving motor in a state where the coupling unit moves downward, the coupling unit for transmitting the rotary power of the driving motor to the basket shaft and a solenoid actuator comprising a solenoid coil and fixed to the lower portion of the tub, the solenoid actuator for supplying electromagnetic repulsive force between the solenoid actuator and the coupling unit so that the coupling unit is separated from the rotor of the driving motor, to thus push the coupling unit upward. The clutch apparatus is formed to have a repulsive type structure unlike a conventional attractive type clutch apparatus. Accordingly, it is possible to collision noise generated when the coupling unit rises and to reduce the amount of consumption of power for maintaining a state where the coupling member rises.

18 Claims, 9 Drawing Sheets

CLUTCH APPARATUS FOR WASHING MACHINE

BACKGROUND OF THE INVENTION

1. Field of the Invention

The present invention relates to a clutch apparatus for a washing machine, and more particularly, to a clutch apparatus for a washing machine for controlling rotary power transmitted from a driving motor to a basket shaft using electromagnetic force.

2. Description of the Background Art

FIG. 1 is a vertical sectional view for a washing machine with a clutch apparatus according to a conventional technology.

In general, a washing machine, as shown in FIG. 1, includes a case 111 for forming a housing space inside, a tub 113 installed in the case 111, the tub 113 for storing water inside, a spin basket 115 rotatably positioned in the tub 113, the spin basket 115 for washing laundry, a pulsator 119 positioned in the spin basket 115 to be in a relative rotary motion with respect to the spin basket 115, the pulsator 119 for forming a water current, and a driving motor 125 formed in the lower portion of the tub 113, the driving motor 125 for providing driving power to the spin basket 115 and the pulsator 119.

FIG. 2 is a vertical sectional view showing the clutch apparatus according to the conventional technology, which is included in the above washing machine.

A basket shaft 117 formed of a hollow member on the bottom of the spin basket 115 is combined with the spin basket 115. The basket shaft 117 is rotatably supported to the tub 113 and a bearing housing 130 by bearings 114.

A pulsator shaft 121 that rotates while being directly coupled with the driving motor 125 so as to rotate the pulsator 119 is inserted into the basket shaft 117. The pulsator shaft 121 is supported to the basket shaft 117 by bearings 120 so as to be in the relative rotary motion.

The driving motor 125 includes a stator 129 fixed to the lower portion of the bearing housing 130 fixed to the tub 113 and a rotor 127 connected from the outer circumference of the stator 129 to the center of the stator 129 and combined with the pulsator shaft 121.

In particular, a clutch device 131 is included between the bearing housing 130 and the rotor 127 so as to selectively transmit the rotary power generated by the driving motor 125 to the basket shaft 117.

The clutch device 131 includes a solenoid actuator 137 fixed to the lower portion of the bearing housing 130, the solenoid actuator 137 for generating electromagnetic force, a coupling member 133 combined with around the basket shaft 117, the coupling member 133 for transmitting or intercepting the rotary power while being in an up and down motion due to the electromagnetic force of the solenoid actuator 137, thus being combined with or being separated from a serration member 122 fixed to the rotor 127, a spring member 141 installed between the coupling member 133 and the bearing housing 130, the spring member 141 for providing elasticity to the coupling member 133 so that the coupling member 133 moves due to the electromagnetic force and then, is returned to an original position.

The solenoid actuator 137 includes a solenoid coil 138 positioned on the outer circumference of the coupling member 133, the solenoid coil 138 for forming an electric field, and a solenoid case 139 fixed to the bearing housing 130, the solenoid case 139 for supporting the solenoid coil 138.

The coupling member 133 includes a serration coupling 134*a* combined with around the basket shaft 117 by a serration method, the serration coupling 134*a* combined with or separated from the serration member 122 and a magnetic coupling 134*b* integrally fixed to around the serration coupling 134, the magnetic coupling 134*b* for generating force corresponding to the solenoid coil 138.

That is, a shaft tooth 118 and a rotor tooth 123 are respectively formed on the outer circumference of the basket shaft 117 and the outer circumference of the serration member 122. A coupling tooth 135 is formed on the inner circumference of the serration coupling 134*a*. The coupling tooth 135 transmits the rotary power of the driving motor 125 to the basket shaft 117 or intercepts the rotary power of the driving motor 125 from the basket shaft 117 while being in the up and down motion along the shaft tooth 118, thus combined with or separated from the rotor tooth 123.

The operation of the washing machine with the clutch apparatus according to the conventional technology will now be described.

When the laundry is washed or is dried after finishing washing the laundry while integrally rotating the spin basket 115 and the pulsator 119, the laundry is washed/dried by driving the driving motor 125 in a state where power is not supplied to the solenoid actuator 137, that is, the solenoid actuator 137 is turned off.

At this time, the coupling tooth 135 simultaneously gears with and is combined with the shaft tooth 118 and the rotor tooth 123 in a state where the coupling member 133 moves downward due to the elasticity of the spring member 141. Therefore, the spin basket 115 integrally rotates together with the pulsator 119.

When the laundry is washed while rotating only the pulsator 119 in a state where the spin basket 115 is stopped, the power is applied to the solenoid actuator 137. The electromagnetic force generated by the solenoid coil 138 forms a magnetic path for connecting the magnetic coupling 134*b* of the coupling member 133, the central region of the rotor 127, and the basket shaft 117 to each other via the bearing housing 130 positioned in the upper portion of the solenoid case 139 and the solenoid case 139. At this time, the magnetic force operates as attraction in the direction, where magnetic reactance is minimized, that is, the direction, where the magnetic coupling 134*b* of the coupling member 133 approaches to the bottom of the solenoid case 139.

Accordingly, the coupling tooth 135 of the coupling member 133 is separated from the rotor tooth 123 and is combined with only the shaft tooth 118, the rotary power transmitted from the driving motor 125 is not transmitted to the spin basket 115 and is transmitted to only the pulsator 119.

When the power supplied to the solenoid actuator 137 is intercepted in such a state, the coupling member 133 falls due to the elasticity of the spring member 141 and self-weight. Accordingly, the coupling tooth 135 simultaneously gears with the shaft tooth 118 and the rotor tooth 123.

However, in the clutch apparatus of the washing machine according to the conventional technology, since the solenoid actuator 137 is formed to use direct current (DC) power, an additional DC power supply circuit for supplying the DC must be included. Also, flux leaks since many parts that can be magnetized are arranged around the solenoid actuator 137. In particular, since the thickness of the bearing housing 130 and the thickness of the solenoid case 139 are about 2 mm, respectively, thus the degree of self-saturation is high, the leakage of the flux deteriorates.

Also, the magnetic force becomes larger than motive power for raising the coupling member 133 at an initial stage as the coupling member 133 rises, thus the distance between the coupling member and the solenoid coil becomes narrower. Accordingly, when the coupling member 133 rises, excessive magnetic force is generated. Also, when the coupling member 133 rises and reaches the final position, the magnetic force becomes stronger. Accordingly, the coupling member 133 collides with the bearing housing 130, thus causing collision noise.

When the elasticity of the spring member 141 increases so as to rapidly fall the coupling member 133 against the magnetic force caused by residual flux, a holding voltage applied to the solenoid coil 138 must be increased in order to maintain the state where the coupling member 133 rises. Accordingly, consumption of power increases.

SUMMARY OF THE INVENTION

Therefore, an object of the present invention is to provide a clutch apparatus of a washing machine, which is capable of preventing the generation of collision noise that can be caused when a coupling member rises by letting a clutching operation occurs using repulsive force that pushes the coupling member upward and of reducing the amount of consumption of power for maintaining a state where the coupling member rises by preventing the increase of the compression force of a spring and the increase of a holding voltage according to residual flux after the coupling member rises.

Another object of the present invention is to provide a clutch apparatus of a washing machine, which is capable of simplifying the structure of the clutch apparatus and of reducing the consumption of the power by including a trans in order to supply another voltage to a solenoid coil according to the position of the coupling member.

To achieve these and other advantages and in accordance with the purposes of the present invention, as embodied and broadly described herein, there is provided a washing machine, comprising a spin basket rotatably installed in a tub, a pulsator positioned in the spin basket to be in a relative rotary motion, a driving motor installed in the lower portion of the tub, a pulsator shaft directly connected from the driving motor to the pulsator, the pulsator shaft for transmitting rotary power, a basket shaft connected from the outside of the shaft to the spin basket so as to form a dual shaft structure together with the pulsator shaft, and a clutch means for transmitting power of the driving motor to the basket shaft or intercepting the power of the driving motor from the basket shaft. The clutch means comprises a coupling member comprising a magnetic member at least in one part, combined around the basket shaft, and combined with a rotor of the driving motor in a state where the coupling member moves downward, the coupling member for transmitting the rotary power of the driving motor to the basket shaft and a solenoid actuator comprising a solenoid coil and fixed to the lower portion of the tub, the solenoid actuator for supplying electromagnetic repulsive force between the solenoid actuator and the coupling member so that the coupling member is separated from the rotor of the driving motor, to thus push the coupling member upward.

The coupling member is combined with the basket shaft and the rotor of the driving motor in a serration method, to thus be in an up and down motion.

A bearing housing for supporting the basket shaft is fixed on the bottom of the tub and the solenoid actuator is supported to the bearing housing.

An elastic means for supplying elasticity so that the coupling member rapidly moves downward when electromagnetic repulsive force is cancelled is comprised between the coupling member and the bearing housing.

The coupling member comprises a cylindrical non-magnetic coupling combined with the basket shaft, the non-magnetic coupling combined with or separated from the rotor of the driving motor, while being in an up and down motion, a ring-shaped conductive coupling corresponding to the solenoid actuator in an up and down direction and fixed to the upper end of the non-magnetic coupling, a ring-shaped magnetic coupling formed of a magnetic member and fixed to the upper end of the non-magnetic coupling, which is the center of the conductive coupling.

The non-magnetic coupling is formed of synthetic resin. A coupling tooth axially and longitudinally formed in the inner circumference of the non-magnetic coupling so that the coupling tooth is combined with the basket shaft by a serration method.

The conductive coupling is formed of a metal having conductivity. A uniform opening is formed between the conductive coupling and the magnetic coupling in a radius direction.

The lower end of an elastic means supported by the lower portion of the tub, the lower end of the elastic means for supplying elasticity to the coupling member is inserted into the opening between the conductive coupling and the magnetic coupling.

The solenoid actuator comprises a solenoid coil positioned around the coupling member and a solenoid case fixed to the lower portion of the tub, the solenoid case for supporting the solenoid coil.

A bearing housing for supporting the basket shaft is installed in the lower portion of the tub and the solenoid case is fixed to the bearing housing.

The solenoid case is formed of a magnetic member. A plurality of axial slits are formed in the solenoid case. The slits are uniformly formed in the solenoid case to be separated from each other by a predetermined distance in the direction of a circumference.

The solenoid case comprises a coil fixing portion having a cylindrical portion and a bottom portion and having the solenoid coil 53 inside and a flange portion extended from the upper end of the coil fixing portion in the direction of a radius and fixed to the lower portion of the tub.

The washing machine further comprises a transformation operating means for applying voltages of different levels to the solenoid coil according to the position of the coupling member. The transformation operating means can supply the voltages of the different levels to the solenoid coil during an initial operation for generating electromagnetic force so as to move the coupling member 41 upward and during a maintaining operation for maintaining a state where the coupling member is completely moved upward.

The transformation operating means comprises a position sensor for sensing the position of the coupling member, a trans installed on a line for supplying power to the solenoid coil, the trans for supplying the voltages of different levels, and a switch means installed on a line between the trans and the solenoid coil, the switch means for selecting one among the voltages of the different levels, which are provided by the trans, according to a signal of the position sensor.

The switch means is a relay switch operated according to a signal of a control unit receiving the signal of the position sensor.

The clutch apparatus of the washing machine according to the present invention is repulsive type unlike a conventional attractive type clutch apparatus. Accordingly, it is possible to prevent the collision noise that can be generated when the coupling member rises. Also, it is possible to reduce the amount of power consumption for maintaining the state where the coupling member rises.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An embodiment of a clutch apparatus of a washing machine according to the present invention will now be described with reference to the attached drawings.

A plurality of embodiments of the clutch apparatus of the washing machine according to the present invention can exist. However, a preferred embodiment will now be described.

Figure 1:
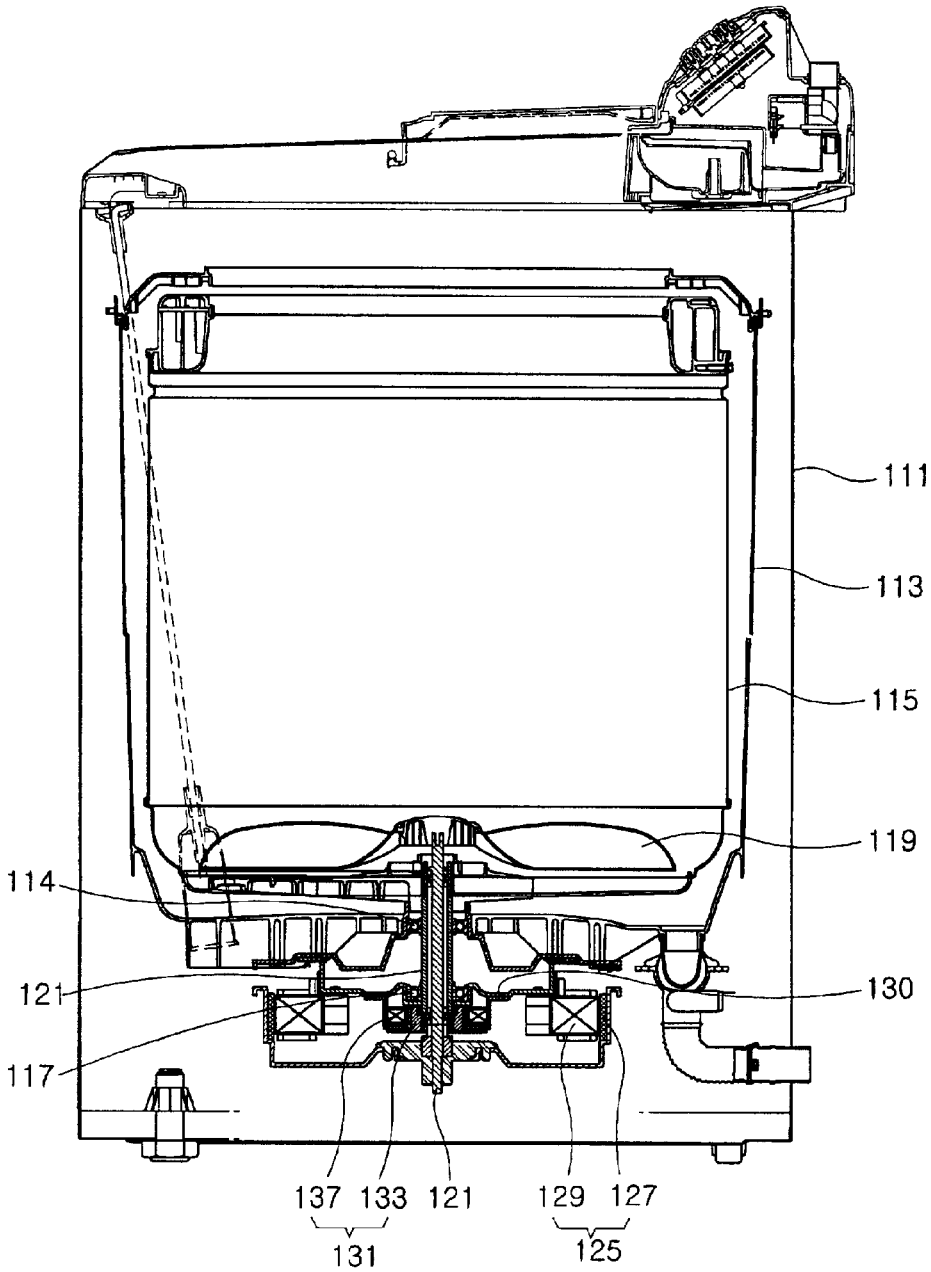
FIG. 1 PRIOR ART
FIG. 1 is a vertical sectional view of a washing machine with a clutch apparatus according to a conventional technology.
Figure 2:
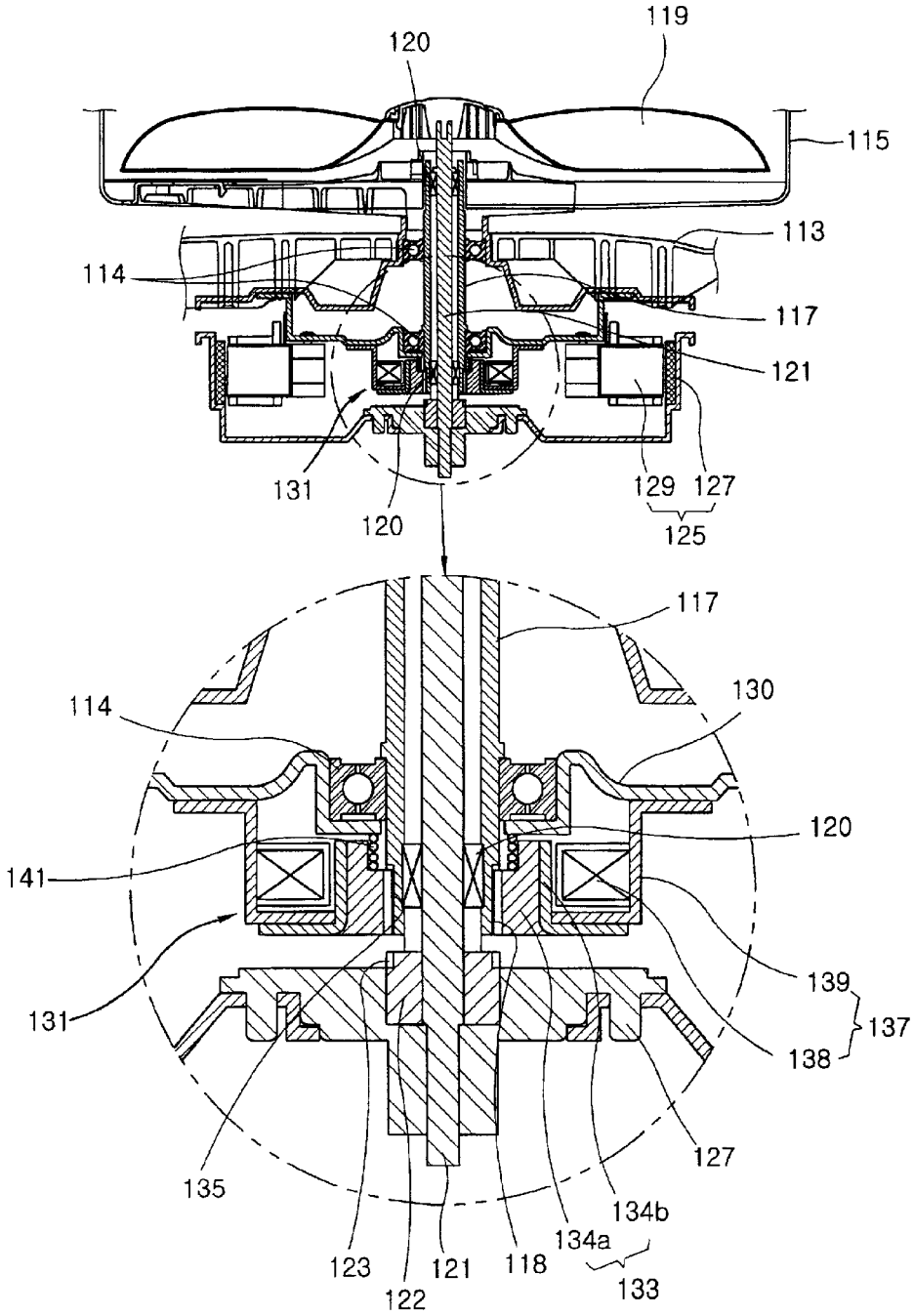
FIG. 2 PRIOR ART
FIG. 2 is a vertical sectional view showing the clutch apparatus shown in FIG. 1 in detail.
Figure 3:
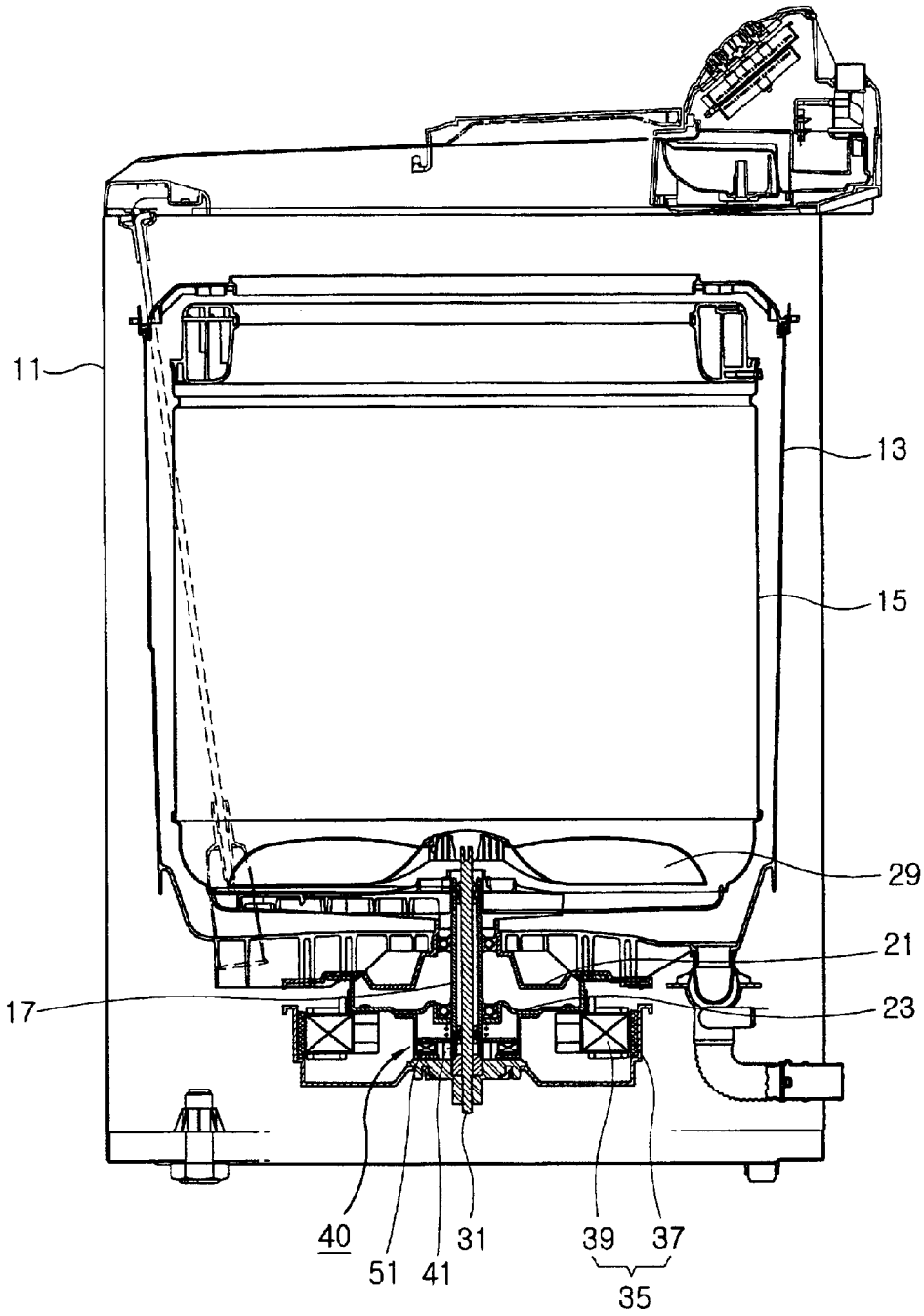
FIG. 3 is a vertical sectional view showing a clutch apparatus according to an embodiment of the present invention.
Figure 4:
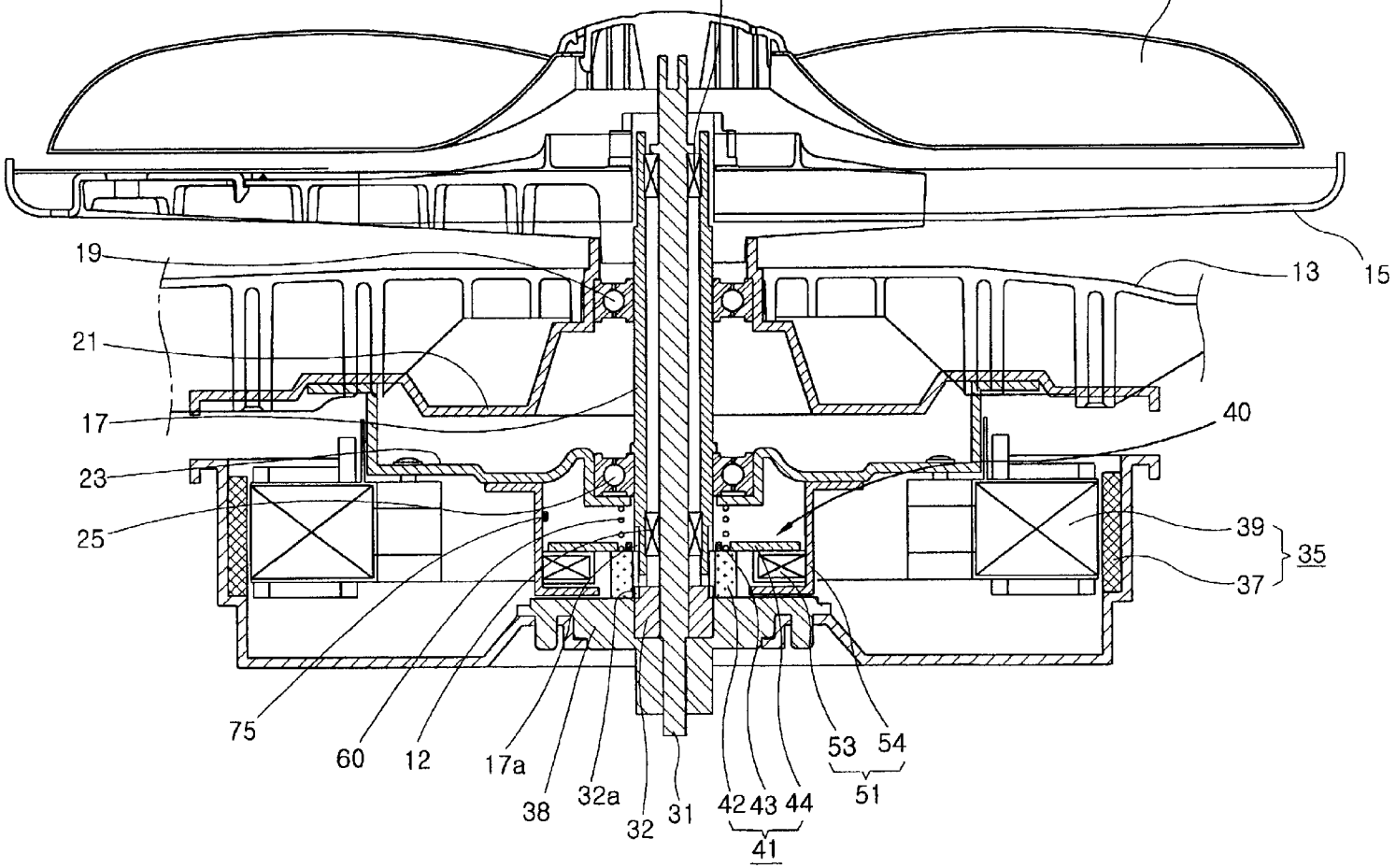
FIG. 4 is an enlarged view showing the clutch apparatus shown in FIG. 3.

FIG. 3 is a vertical sectional view showing a washing machine with a clutch apparatus according to an embodiment of the present invention. FIG. 4 is an enlarged view of main portions of FIG. 3.

Referring to FIG. 3, a washing machine using the clutch apparatus according to the present invention includes a case 11, a tub 13 supported to the inside of the case 11, the tub 13 for storing water, a spin basket 15 rotatably installed inside the tub 13, the spin basket 15 for washing laundry, a pulsator 29 installed inside the spin basket 15 to be in a relative motion with respect to the spin basket 15, and a driving motor 35 fixed to the lower portion of the tub 13, the driving motor 35 for rotatively driving the spin basket 15 and the pulsator 29.

Referring to FIG. 4, the spin basket 15 is combined with a basket shaft 17 formed of a hollow member on the bottom of the spin basket 15. The basket shaft 17 is rotatably supported to bearing housings 21 and 23 fixed to the tub 13 by bearings 19 and 25.

A shaft tooth 17*a* in the form of a spline or a serration is axially formed over a predetermined length section on the lower outer circumference in the lower portion of the basket shaft 17.

A pulsator shaft 31 that rotates while being directly coupled with the driving motor 35 so as to form a dual axial structure and to rotate the pulsator 29 passes through the inside of the basket shaft 17. The pulsator shaft 31 is supported to the basket shaft 17 by bearings 12 so as to be in a relative motion.

The driving motor 35 includes a stator 39 fixed in the lower portion of the lower bearing housing 23 and a rotor 37 connected from the outer circumference of the stator 39 to the center of the stator 39 and combined with the pulsator shaft 31.

A bushing 38 combined with the pulsator shaft 31 is installed in the center of the rotor 37. A serration member 32 integrally combined with the pulsator shaft 31 is fixed in the upper center portion of the bushing 38.

A rotor tooth 32*a* in the form of the spline or the serration is formed in the same direction as the direction of the shaft tooth 17*a* on the outer circumference of the serration member 32.

A repulsive type clutch device 40 is included between the bearing housing 23 and the bushing 38 so that the rotary power generated by the driving motor is selectively transmitted to the basket shaft 17.

The clutch device 40 includes a solenoid actuator 51 fixed to the lower portion of the bearing housing, the solenoid actuator 51 for generating electromagnetic force, a coupling member 41 combined around the basket shaft 17, the coupling member 41 for transmitting or interpreting the rotary power while moving up and down by the electromagnetic force of the solenoid actuator 51, thus combined with or separated from the serration member 32, and a spring member 60 installed between the coupling member 41 and the bearing housing 23, the spring member 60 for providing elasticity so that the coupling member 41 moves due to the electromagnetic force and is returned to an original position.

Figure 5:
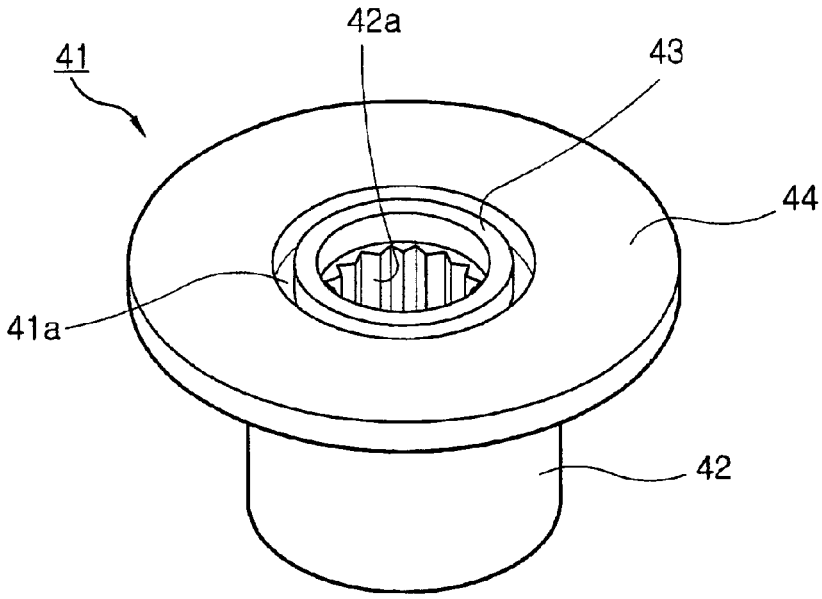
FIG. 5 is a perspective view showing a coupling member according to the present invention.

As shown in FIG. 5, the coupling member 41 includes a cylindrical non-magnetic coupling 42, in which a coupling tooth 42*a* formed by engaging the shaft tooth 17*a* with the rotor tooth 32*a* is formed, a cylindrical magnetic coupling 43 axially and extendedly formed in the upper portion of the non-magnetic coupling 42, and a ring-shaped conductive coupling 44 fixed on the upper outside of the magnetic coupling.

The non-magnetic coupling 42 is formed of synthetic resin and is formed to have a length such that the coupling tooth 42*a* of the non-magnetic coupling 42 simultaneously gears with the shaft tooth 17*a* and the rotor tooth 32*a* in a state where the non-magnetic coupling 42 completely falls along the basket shaft 17.

The magnetic coupling 43 is formed of a magnetic member so as to form a magnetic field corresponding to the solenoid actuator 51.

The conductive coupling 44 is formed of a metal having excellent conductivity such as aluminum (Al) and is formed to have an internal diameter larger than the external diameter of the magnetic coupling 43 so that the inner circumference of the conductive coupling 44 is separated from the external diameter of the magnetic coupling 43 by a predetermined distance.

The spring member 60 for supplying elasticity to the coupling member 41 so that the coupling member 41 does not reside in the upper portion due to residual flux and rapidly falls is positioned in an opening region 41*a* between the magnetic coupling 43 and the conductive coupling 44.

Since the coupling member 41 can reduce the self-weight since the non-magnetic coupling 42 is formed of the synthetic resin lighter than the metal. Accordingly, the coupling member 41 can reduce the electromagnetic force of the solenoid actuator 51 required for an initial operation.

The solenoid actuator 51 is ring-shaped so as to house the coupling member 41 inside. The solenoid actuator 51 includes a solenoid coil 53 for forming the electromagnetic force when power is applied and a solenoid case 54 formed of a magnetic material so as to form the main path of an alternating current (AC) magnetic field and fixed to the lower bearing hosing 23 so as to support the solenoid coil 53.

Figure 6:
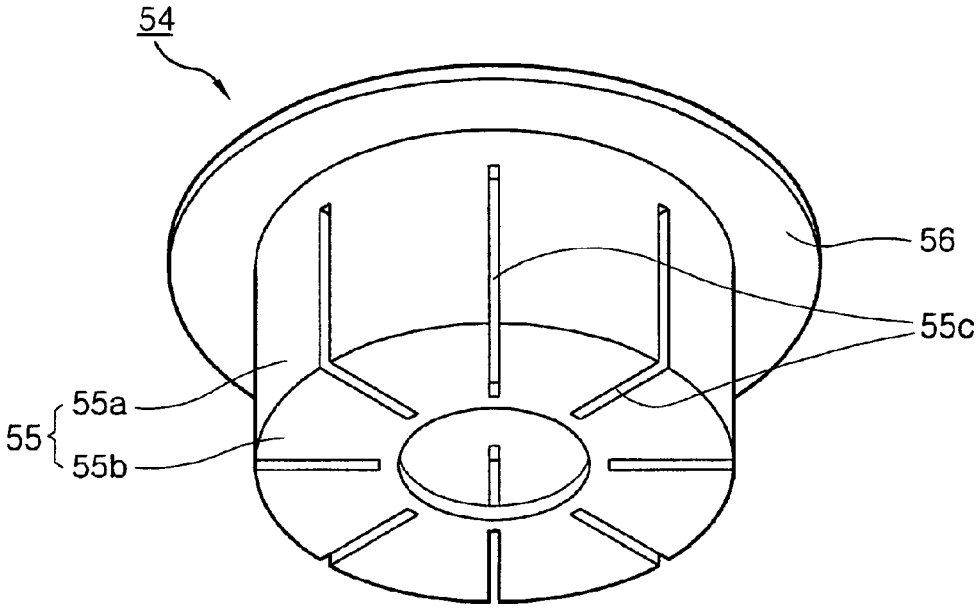
FIG. 6 is a perspective view showing a solenoid case according to the present invention.

As shown in FIG. 6, the solenoid case 54 includes a coil fixing portion 55, which has a cylindrical portion 55*a* and a bottom portion 55*b* and the solenoid coil 53 is installed inside and a flange portion 56 extended from the upper end of the coil fixing portion 55 in a radius direction and fixed to the lower bearing housing 23.

In particular, a plurality of slits 55*c* connected from the cylindrical portion 55*a* to the bottom are formed in the coil fixing portion 55 so as to reduce the eddy current. The slits 55*c* are uniformly formed to be separated from each other by a predetermined distance in a direction of the circumference of the cylindrical portion 55*a*.

The slits 55*c* prevent the eddy current from being abandoned to the solenoid case 54 and cools the solenoid coil 53 by forming a channel, through which air is flown.

The clutch device according to the present invention includes a transformation operating unit so as to apply voltages of different levels to the solenoid coil 53 according to the position of the coupling member 41.

The transformation operating unit can supply the voltages of the different levels to the solenoid coil 53 during an initial operation for generating the electromagnetic force so as to move the coupling member 41 upward and a maintaining operation for maintaining a state where the coupling member 41 is completely moved upward.

The transformation operating unit includes a position sensor 75 installed in the solenoid case 54, the position sensor 75 for sensing the position of the coupling member 41, a trans 57 installed on a line for supplying the power to the solenoid coil 53, the trans 57 for providing the voltages of the different levels, and a relay switch 59 installed on a line between the trans 57 and the solenoid coil 53, the relay switch 59 for selecting one among the voltages of different levels, which are provided by the trans, according to a signal of the position sensor 75.

Output terminals 58*a* and 58*b* are formed in the trans 57 so as to output the voltages of the different levels. A relay switch 59 including a plurality of contact points A and B connected to the output terminals 58*a* and 58*b* of the trans 57 is included between the solenoid coil 53 and the trans 57 so that the voltages of the different levels can be applied.

The relay switch 59 is preferably operated according to the signal of a control unit 70 that received the signal of the position sensor 75.

The operation and the effect of the clutch apparatus according to the present invention will now be described.

When the laundry is washed while integrally rotating the spin basket 15 and the pulsator 29 or the laundry is to be dried after completing the washing of the laundry, the driving motor 35 is operated in a state where the power is not supplied to the solenoid actuator 51, that is, a state where the solenoid actuator 51 is turned off.

At this time, the coupling member 41 falls while contacting the upper surface of the rotor 37. Accordingly, the coupling tooth 42*a* is combined with the shaft tooth 17*a* and the rotor tooth 32*a* in a state where the coupling tooth 42*a* simultaneously gears with the shaft tooth 17 and the rotor tooth 32*a*. Therefore, the rotary power of the rotor 37 is transmitted to the basket shaft 17 through the coupling member 41 according to the operation of the driving motor 35. Accordingly, the spin basket 15 integrally rotates together with the pulsator 29.

When the laundry is washed while rotating the pulsator 29 in a state where the spin basket 15 is stopped, the coupling member 41 is moved upward by applying the power to the solenoid coil 53 of the solenoid actuator 51. At this time, the coupling tooth 42*a* of the coupling member 41 is separated from the rotor tooth 32*a* and is combined with only the shaft tooth 17*a*, the rotary power generated by the driving motor 35 is transmitted to only the pulsator 29.

Figure 7:
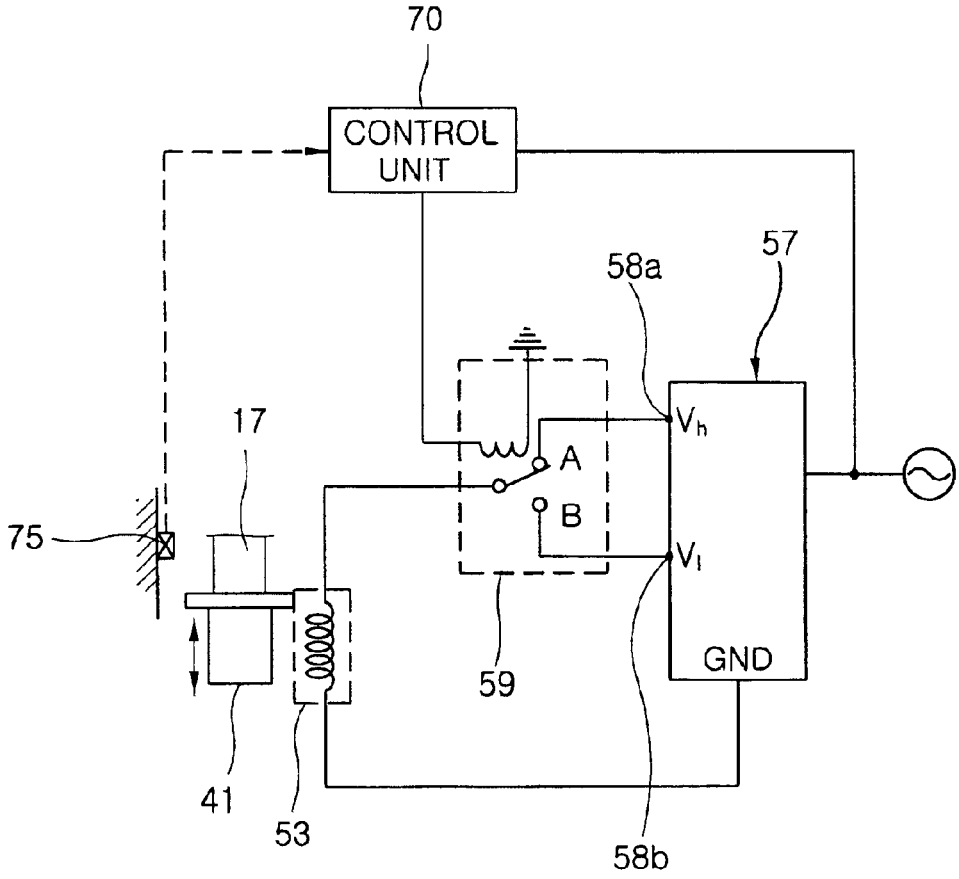
FIG. 7 shows a control circuit of a clutch apparatus according to the present invention.

During the initial operation where the power starts to be applied to the solenoid coil 53 in order to raise the coupling member 41, the relay switch 59 contacts the contact point A so that a higher level of voltage is applied as shown in FIG. 7.

When a high level of voltage is applied to the solenoid coil 53, the eddy current is abandoned to the conductive coupling 44 due to the AC magnetic field formed by the solenoid coil 53 between the solenoid case 54 and the lower bearing housing 23. At this time, electromagnetic repulsive force corresponding to Lorenz force operates to the conductive coupling 44. Accordingly, the coupling member 41 is separated from the rotor tooth 32*a* and moves upward.

Figure 8A:
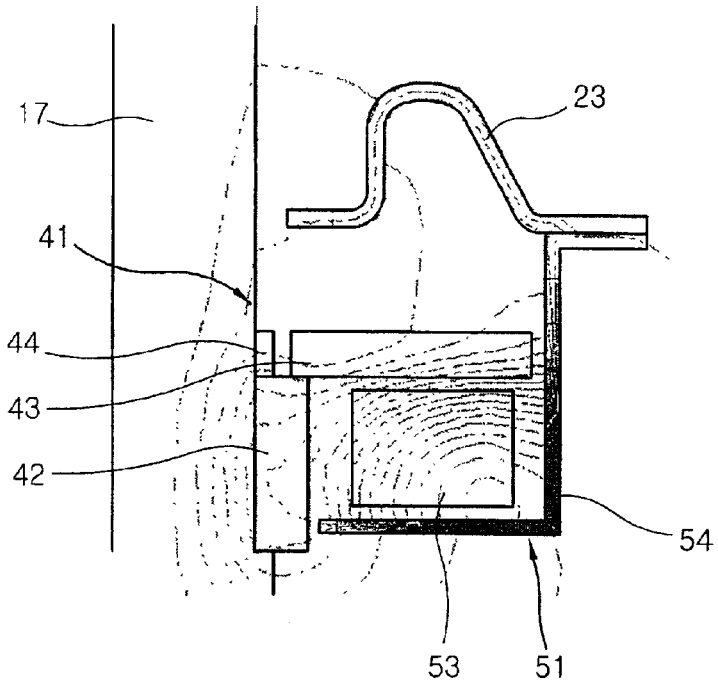
FIGS. 8A and 8B show the distribution of a magnetic field and the distribution of eddy current abandoned to the inside of conductive coupling in the position where the coupling member according to the present invention initially operates.
Figure 8B:
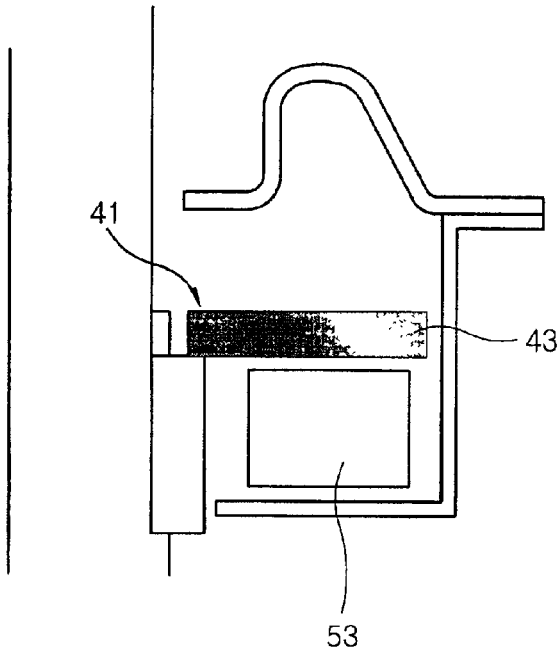
Figure 9A:
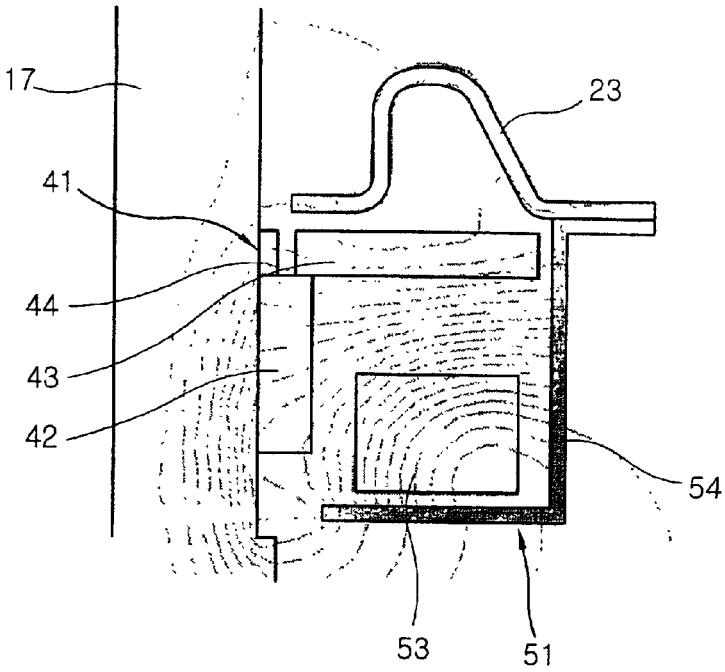
FIGS. 9A and 9B show the distribution of a magnetic field and the distribution of eddy current abandoned to the inside of conductive coupling in the position where the coupling member according to the present invention completely rises.
Figure 9B:
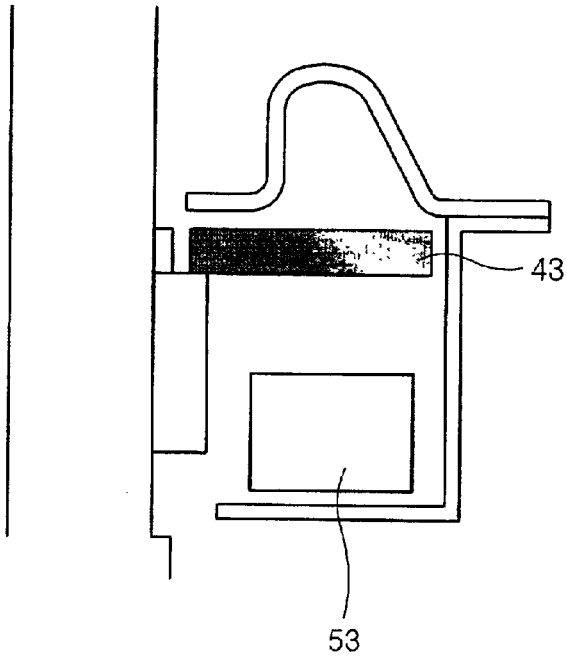

FIGS. 8A and 8B the distribution of the magnetic field and the distribution of the eddy current abandoned to the inside of the conductive coupling 44 in the position where the coupling member 41 initially operates. FIGS. 9A and 9B show the distribution of the magnetic field and the distribution of the eddy current abandoned to the inside of conductive coupling in the position where the coupling member completely rises.

As the coupling member 41 rises, the magnitude of the eddy current abandoned to the conductive coupling 44 becomes smaller. The elasticity of the spring member 60 arranged in the upper portion of the coupling member 41 becomes larger, the coupling member 41 stops in a state where the coupling member 41 does not collide with the lower bearing housing 23. Accordingly, the collision noise is not generated.

When the coupling member 41 rises, to thus reach the position where the coupling member 41 finally rises, the relay switch 59 contacts the contact point B and operates so that a relatively low level of voltage can be applied to the solenoid coil 53. At this time, the coupling member 41 is maintained raised.

Figure 10:
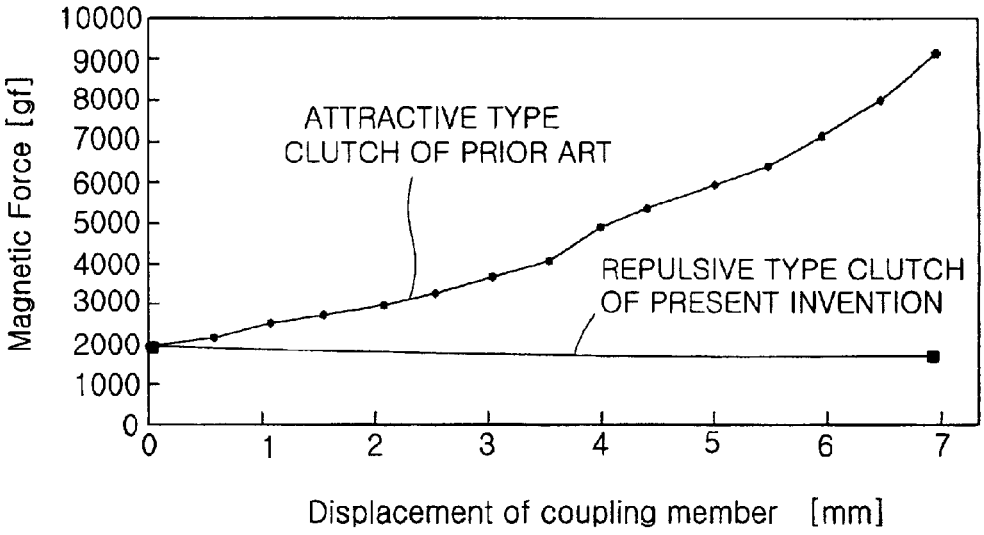
FIG. 10 is a graph comparing the magnetic force according to the displacement of the coupling member of an attractive type clutch apparatus according to a conventional technology with the magnetic force according to the displacement of the coupling member of a repulsive type clutch apparatus according to the present invention.

FIG. 10 is a graph comparing the magnetic force according to the displacement of the coupling member of an attractive type clutch apparatus according to a conventional technology with the magnetic force according to the displacement of the coupling member of a repulsive type clutch apparatus according to the present invention. While the electromagnetic force becomes gradually larger as the displacement of the coupling member becomes larger in the conventional attractive type clutch apparatus, the electromagnetic force becomes smaller than the initial electromagnetic force as the displacement of the coupling member becomes larger in the repulsive type clutch apparatus according to the present invention.

When the power applied to the solenoid coil 53 of the solenoid actuator 51 is intercepted, the coupling member 41 rapidly falls due to the elasticity and the self-weight of the spring member 60. At this time, the coupling tooth 42*a* is combined with the shaft tooth 17*a* and the rotor tooth 32*a* in a state where the coupling tooth 42*a* simultaneously gears with the shaft tooth 17*a* and the rotor tooth 32*a*. Accordingly, it is possible to integrally drive the spin basket 15 and the pulsator 29.

Since the clutch apparatus of the washing machine according to the present invention is repulsive type where the solenoid actuator pushes the coupling member upward in the lower portion unlike the attractive type clutch apparatus, it is possible to prevent the collision noise that can be generated while the coupling member rises.

Also, in the clutch apparatus of the washing machine according to the present invention, since almost parts that form the coupling member such as the non-magnetic coupling and the conductive coupling are formed of the non-magnetic material, it is possible to prevent the compressive force and the holding voltage from rising due to the residual flux after the coupling member rises. Accordingly, it is possible to reduce the amount of the consumption of the power for maintaining the coupling member raised.

Also, in the clutch apparatus of the washing machine according to the present invention, the trans for providing the different voltages to the solenoid coil is included. Accordingly, it is possible not to use the conventionally used parts for DC power supply and to reduce the amount of the consumption of the power.

What is claimed is:

1. A washing machine, comprising:

a spin basket rotatably positioned in a tub;

a pulsator positioned in the spin basket to be in a relative rotary motion;

a driving motor installed at the lower portion of the tub;

a pulsator shaft directly connected from the driving motor to the pulsator, the pulsator shaft for transmitting rotary power;

a basket shaft connected from the outside of the pulsator shaft to the spin basket so as to form a dual shaft structure together with the pulsator shaft; and a clutch means for transmitting power of the driving motor to the basket shaft or intercepting the power of the driving motor to the basket shaft wherein the clutch means comprises:

a coupling member having a magnetic member at least in one part, combined around the basket shaft, and combined with a rotor of the driving motor in a state where the coupling member moves downward, the coupling member for transmitting the rotary power of the driving motor to the basket shaft;

a solenoid actuator having a solenoid coil and fixed to the lower portion of the tub, the solenoid actuator for supplying electromagnetic repulsive force between the solenoid actuator and the coupling member so that the coupling member is separated from the rotor of the driving motor, to thus push the coupling member upward; and a transformation operating means for applying voltages of different levels to the solenoid coil according to the position of the coupling member, wherein the transformation operating means supplies a voltage of a higher level to the solenoid coil during an initial operation for generating electromagnetic force so as to move the coupling member upward, and supplies a voltage of a lower level during a maintaining operation for maintaining a state where the coupling member is completely moved upward.

2. The washing machine of claim 1, wherein the coupling member is combined with the basket shaft and the rotor of the driving motor in a serration method, to thus facilitate an up and down motion.

3. The washing machine of claim 1, wherein a bearing housing for supporting the basket shaft is fixed on the bottom of the tub and the solenoid actuator is supported by the bearing housing.

4. The washing machine of claim 3, wherein an elastic means for supplying elasticity so that the coupling member rapidly moves downward when electromagnetic repulsive force is cancelled is located between the coupling member and the bearing housing.

5. The washing machine of claim 1, wherein the solenoid actuator comprises a solenoid coil positioned around the coupling member and a solenoid case fixed to the lower portion of the tub, the solenoid case for supporting the solenoid coil.

6. The washing machine of claim 5, wherein a bearing housing for supporting the basket shaft is installed in the lower portion of the tub and the solenoid case is fixed to the bearing housing.

7. The washing machine of claim 5, wherein the solenoid case is formed of a magnetic member.

8. The washing machine of claim 5, wherein a plurality of axial slits are formed in the solenoid case.

9. The washing machine of claim 8, wherein the slits are uniformly formed in the solenoid case to be separated from each other by a predetermined distance in the direction of a circumference.

10. A washing machine, comprising:

a spin basket rotatably positioned in a tub;

a pulsator positioned in the spin basket to be in a relative rotary motion;

a driving motor installed at the lower portion of the tub;

a pulsator shaft directly connected from the driving motor to the pulsator, the pulsator shaft for transmitting rotary power;

a basket shaft connected from the outside of the pulsator shaft to the spin basket so as to form a dual shaft structure together with the pulsator shaft; and a clutch means for transmitting power of the driving motor to the basket shaft or intercepting the power of the driving motor to the basket shaft wherein the clutch means comprises:

a coupling member having a magnetic member at least in one part, combined around the basket shaft, and combined with a rotor of the driving motor in a state where the coupling member moves downward, the coupling member for transmitting the rotary power of the driving motor to the basket shaft; and a solenoid actuator having a solenoid coil and fixed to the lower portion of the tub, the solenoid actuator for supplying electromagnetic repulsive force between the solenoid actuator and the coupling member so that the coupling member is separated from the rotor of the driving motor, to thus push the coupling member upward, wherein the coupling member comprises a cylindrical non-magnetic coupling combined with the basket shaft, the non-magnetic coupling combined with or separated from the rotor of the driving motor, while being in an up and down motion, a ring-shaped conductive coupling corresponding to the solenoid actuator in an up and down direction and fixed to the upper end of the non-magnetic coupling, a ring-shaped magnetic coupling formed of a magnetic member and fixed to the upper end of the non-magnetic coupling, which is the center of the conductive coupling.

11. The washing machine of claim 10, wherein the non-magnetic coupling is formed of synthetic resin.

12. The washing machine of claim 10, wherein a coupling tooth is axially and longitudinally formed in the inner circumference of the non-magnetic coupling so that the coupling tooth is combined with the basket shaft by a serration method.

13. The washing machine of claim 10, wherein the conductive coupling is formed of a metal having conductivity.

14. The washing machine of claim 10, wherein a uniform opening is formed between the conductive coupling and the magnetic coupling in a radius direction.

15. The washing machine of claim 14, wherein the lower end of an elastic means is supported by the lower portion of the tub, the lower end of the elastic means is for supplying elasticity to the coupling member and is inserted into the opening between the conductive coupling and the magnetic coupling.

16. A washing machine, comprising:

a spin basket rotatably positioned in a tub;

a pulsator positioned in the spin basket to be in a relative rotary motion;

a driving motor installed at the lower portion of the tub;

a pulsator shaft directly connected from the driving motor to the pulsator, the pulsator shaft for transmitting rotary power;

a basket shaft connected from the outside of the pulsator shaft to the spin basket so as to form a dual shaft structure together with the pulsator shaft; and a clutch means for transmitting power of the driving motor to the basket shaft or intercepting the power of the driving motor to the basket shaft wherein the clutch means comprises:

a coupling member having a magnetic member at least in one part, combined around the basket shaft, and combined with a rotor of the driving motor in a state where the coupling member moves downward, the coupling member for transmitting the rotary power of the driving motor to the basket shaft; and a solenoid actuator having a solenoid coil and fixed to the lower portion of the tub, the solenoid actuator for supplying electromagnetic repulsive force between the solenoid actuator and the coupling member so that the coupling member is separated from the rotor of the driving motor, to thus push the coupling member upward, wherein the solenoid actuator comprises a solenoid coil positioned around the coupling member and a solenoid case fixed to the lower portion of the tub, the solenoid case for supporting the solenoid coil, and wherein the solenoid case comprises a coil fixing portion having a cylindrical portion and a bottom portion and having the solenoid coil inside and a flange portion extended from the upper end of the coil fixing portion in the direction of a radius and fixed to the lower portion of the tub.

17. A washing machine, comprising:

a spin basket rotatably positioned in a tub;

a pulsator positioned in the spin basket to be in a relative rotary motion;

a driving motor installed at the lower portion of the tub;

a pulsator shaft directly connected from the driving motor to the pulsator, the pulsator shaft for transmitting rotary power;

a basket shaft connected from the outside of the pulsator shaft to the spin basket so as to form a dual shaft structure together with the pulsator shaft; and a clutch means for transmitting power of the driving motor to the basket shaft or intercepting the power of the driving motor to the basket shaft wherein the clutch means comprises:

a coupling member having a magnetic member at least in one part, combined around the basket shaft, and combined with a rotor of the driving motor in a state where the coupling member moves downward, the coupling member for transmitting the rotary power of the driving motor to the basket shaft;

a solenoid actuator having a solenoid coil and fixed to the lower portion of the tub, the solenoid actuator for supplying electromagnetic repulsive force between the solenoid actuator and the coupling member so that the coupling member is separated from the rotor of the driving motor, to thus push the coupling member upward; and a transformation operating means for applying voltages of different levels to the solenoid coil according to the position of the coupling member, wherein the transformation operating means comprises a position sensor for sensing the position of the coupling member, a trans installed on a line for supplying power to the solenoid coil, the trans for supplying the voltages of different levels, and a switch means installed on a line between the trans and the solenoid coil, the switch means for selecting one among the voltages of the different levels, which are provided by the trans, according to a signal of the position sensor.

18. The washing machine of claim 17, wherein the switch means is a relay switch operated according to a signal of a control unit receiving the signal of the position sensor.

* * * * *